US005595524A

United States Patent [19]

Gundy

[11] Patent Number: 5,595,524

[45] Date of Patent: Jan. 21, 1997

[54] GRINDING APPARATUS AND METHOD WHICH SUPPORTS A WORKPIECE ON THE SURFACE BEING GROUND

[75] Inventor: William P. Gundy, Milford, N.H.

[73] Assignee: NPC, Inc., Milford, N.H.

[21] Appl. No.: 393,155

[22] Filed: Feb. 17, 1995

[51] Int. Cl.[6] ..... B24B 49/00

[52] U.S. Cl. ..... 451/5; 451/207; 451/51; 451/242

[58] Field of Search ..... 451/5, 49, 51, 451/178, 189, 212, 221, 398, 402, 406, 914, 207, 242, 246, 249, 27, 441

[56] References Cited

U.S. PATENT DOCUMENTS

| | | | |
|---|---|---|---|
| 3,101,577 | 8/1963 | Skugghall | 451/207 |
| 3,852,917 | 12/1974 | McKown | 451/51 |
| 3,967,414 | 7/1976 | Tamesui et al. | 51/165 |
| 4,195,448 | 4/1980 | Check et al. | 51/165 |
| 4,412,404 | 11/1983 | Fundell | 451/242 |
| 4,517,867 | 5/1985 | Fuminier | 82/101 |
| 4,586,407 | 5/1986 | Nall | 82/1 |
| 4,612,730 | 9/1986 | Gundy | 51/3 |
| 5,218,785 | 6/1993 | Hall | 451/51 |

FOREIGN PATENT DOCUMENTS 0566879 10/1993 European Pat. Off. .

OTHER PUBLICATIONS

"MAB" by Zublin, D-77673 Keh/Rhein, Germany.
"Sagen-Frasen-Bohren" by Alles von Sr Schindler, D-93057 Regensburg, Germany.

*Primary Examiner*—Bruce M. Kisliuk
*Assistant Examiner*—George Nguyen
*Attorney, Agent, or Firm*—Daniel J. Bourque; Kevin J. Carroll

[57] ABSTRACT

A method and apparatus for grinding a surface on a workpiece, such as a spigot on a pipe, while supporting the workpiece on the surface being ground. The grinding apparatus includes workpiece support wheels, two of which are positioned beneath the workpiece and contact the workpiece at the surface being ground. The grinding apparatus also includes a rotator mechanism, such as a motor which drives one of the workpiece support wheels in frictional contact with the workpiece outer surface, for rotating the workpiece. The grinding apparatus further includes a surface grinding mechanism, such as a motor and grinding or cutting wheel positioned generally between the two workpiece support wheels and which contacts the surface being ground. The cutter mechanism is adjustable in a vertical direction and angularly to grind an angled surface. According to the method of grinding, the grinding surface of the workpiece is maintained in contact with the two workpiece support wheels so that the workpiece self-feeds towards the surface grinding mechanism. The grinding apparatus can also include an end workpiece support to prevent horizontal movement of the workpiece, a top workpiece support to prevent vertical movement, a measuring device for measuring the depth of the grinding surface, and an adjustment control mechanism for automatically controlling the adjustment of the cutter mechanism.

31 Claims, 5 Drawing Sheets

GRINDING APPARATUS AND METHOD WHICH SUPPORTS A WORKPIECE ON THE SURFACE BEING GROUND

FIELD OF THE INVENTION

This invention relates to a method and apparatus for grinding a workpiece and in particular, for grinding a spigot in a workpiece while supporting the workpiece on the spigot surface being ground.

BACKGROUND OF THE INVENTION

In constructing and replacing underground piping systems, such as manholes and sewer systems, relatively large pipes are needed, such as reinforced or non-reinforced concrete pipes and manhole risers. Such pipes are generally available in various predetermined lengths, but often a pipe is too long for a particular usage and must be cut to an appropriate size. The pipes, however must be able to fit together with other pipes forming closely fitting pipe joints and an interconnected system of pipes. In order to fit with another pipe, a spigot is formed at the end of one pipe which has been cut and mates with a corresponding bell end of another pipe.

Spigots are generally molded into a pipe but can also be formed by machining the end of a pipe, such as by grinding or milling. However, many grinding machines are expensive, difficult to operate, or incapable of grinding large concrete pipes. Other grinding machines fail to grind a spigot accurately with the necessary roundness and required tolerances. Additionally, prior art grinding machines are not easily adjustable for various diameter pipes often used on any one given job. Thus, prior grinding machines have not provided a simple, economic and accurate way of forming spigots in the ends of large pipes which have been cut to size.

Accordingly, what is needed is a method and apparatus for grinding a surface of a pipe to form, for example, a spigot whereby the spigot can be accurately and easily formed by supporting the pipe on the surface which is being ground. Furthermore, such a grinding apparatus should rotatably support the pipe by resting the pipe on support rollers positioned generally beneath the pipe without the need for complex workpiece support and rotation mechanisms and without the need to adjust the support rollers for various diameter pipes.

SUMMARY OF THE INVENTION

The present invention features a method of grinding a surface on a workpiece using a grinding apparatus having a workpiece support mechanism, a surface grinding mechanism, and a workpiece rotator mechanism. The method includes rotatably supporting the workpiece on the workpiece support mechanism whereby workpiece support rollers included in the workpiece support mechanism contact and support the workpiece on the surface which is being ground. The method further includes rotating the workpiece with the workpiece rotator mechanism and grinding the surface at a first end of the workpiece with the surface grinding mechanism, while maintaining contact on the surface being ground with the workpiece support rollers.

The preferred method includes resting the workpiece lengthwise on at least four workpiece support roller members, each roller member including two (2) wheels, positioned generally beneath the workpiece and entirely supporting the weight of the workpiece. The preferred method of rotating the workpiece includes rotating at least one of the four workpiece support roller members. Preferably, at least one of the workpiece support roller members which acts as the workpiece rotator mechanism rotates the workpiece at a second end opposite the first end of the workpiece which is being ground.

The method may also include further supporting the workpiece at the second end of the workpiece to prevent horizontal movement of the workpiece, as well as supporting the workpiece at a top region of the first end, to prevent vertical movement of the workpiece and to maintain contact of the surface being ground with the grinding mechanism.

According to the preferred method, the workpiece grinding mechanism is located between two (2) workpiece support roller members and at a horizontal level which is below the top surface of the roller members. This position of the grinding mechanism in relation to the roller members serves to ensure that the workpiece self-feeds toward the surface grinding mechanism. By supporting one end of the pipe on the surface being ground, the pipe self-feeds itself towards the grinding or cutter mechanism of the present invention as the grinding surface is ground. Also, the cutter mechanism is easily adjustable to form a spigot of any angle or shape in the end of a pipe. The cutter tool can also be changed to cut any required spigot configuration such as single or double offset and confined "0" ring groove. The rotating workpiece moves toward the grinding mechanism as the surface is ground and is maintained in contact with the workpiece support by the weight of the workpiece and the top support.

Preferably, the grinding mechanism rotates a cutter or grinder in a direction opposite the direction of rotation of the workpiece. The method can also include adjusting the surface grinding mechanism in a vertical direction or adjusting an angle of the cutter mechanism to grind an angled surface. In one embodiment, the load current of the driving motor driving the cutter can be monitored to automatically adjust the feed of the surface grinding mechanism.

The grinding apparatus includes a frame, for stabilizing the grinding apparatus on a generally flat surface. The workpiece support mechanism is coupled to the frame, for rotatably supporting the workpiece on the surface being ground.

In the preferred embodiment, the workpiece support mechanism includes at least four workpiece support roller members. One roller of each of the two rollers of each roller mechanism is located a different distance from the grinding surface of the grinding mechanism, to allow for different diameter pipes to be ground without having to adjust the roller members of the workpiece support mechanism. The surface grinding mechanism of the grinding apparatus is fixed to the frame between the first and second opposing workpiece support members. The preferred embodiment of the surface grinding mechanism includes a rotating cutter adapted to be positioned adjacent the surface to be ground and a motor for driving the rotating cutter. The cutter angle and shape can be changed and adjusted. The preferred embodiment of the work piece rotator mechanism includes a motor which drives one or more of the rotatable workpiece support roller members, to frictionally contact and rotate the workpiece. The first and second workpiece support roller members are preferably fixed to the frame at one end, for supporting the first end of the workpiece on the surface being ground. Third and fourth workpiece support roller members are fixed to a moveable platform proximate the second and opposite end of the frame, for supporting the workpiece generally at a second end. The moveable platform allows the third and fourth workpiece support roller members along with the rotator mechanism, to be adjusted for various pipe lengths.

In a preferred embodiment, the grinding apparatus includes an adjustable end workpiece support, fixed to the moveable platform at an end opposite the surface grinding mechanism, and adapted to contact the second end of the workpiece, for preventing horizontal movement of the workpiece away from the grinding mechanism during grinding. In another embodiment, a top workpiece support is fixed to the frame and is adapted to be positioned against a top region of the workpiece, for assuring that the surface being ground is maintained in contact with the first and second workpiece support roller members and the surface grinding mechanism.

In the a preferred embodiment of the grinding apparatus, the apparatus includes a surface grinding adjustment mechanism, coupled to the surface grinding mechanism, including a vertical adjustment mechanism to adjust grinding depth, and a grinder angle adjustment mechanism. The grinding apparatus can further include a surface or cutter adjustment control mechanism, for controlling and monitoring adjustment of the rate of feed of the surface grinding mechanism. Additionally, the grinding apparatus can include a measuring device, for measuring pipe spigot diameter, depth and an angle of the surface (spigot) being ground, and to automatically stop the grinding procedure when a proper spigot diameter has been achieved.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
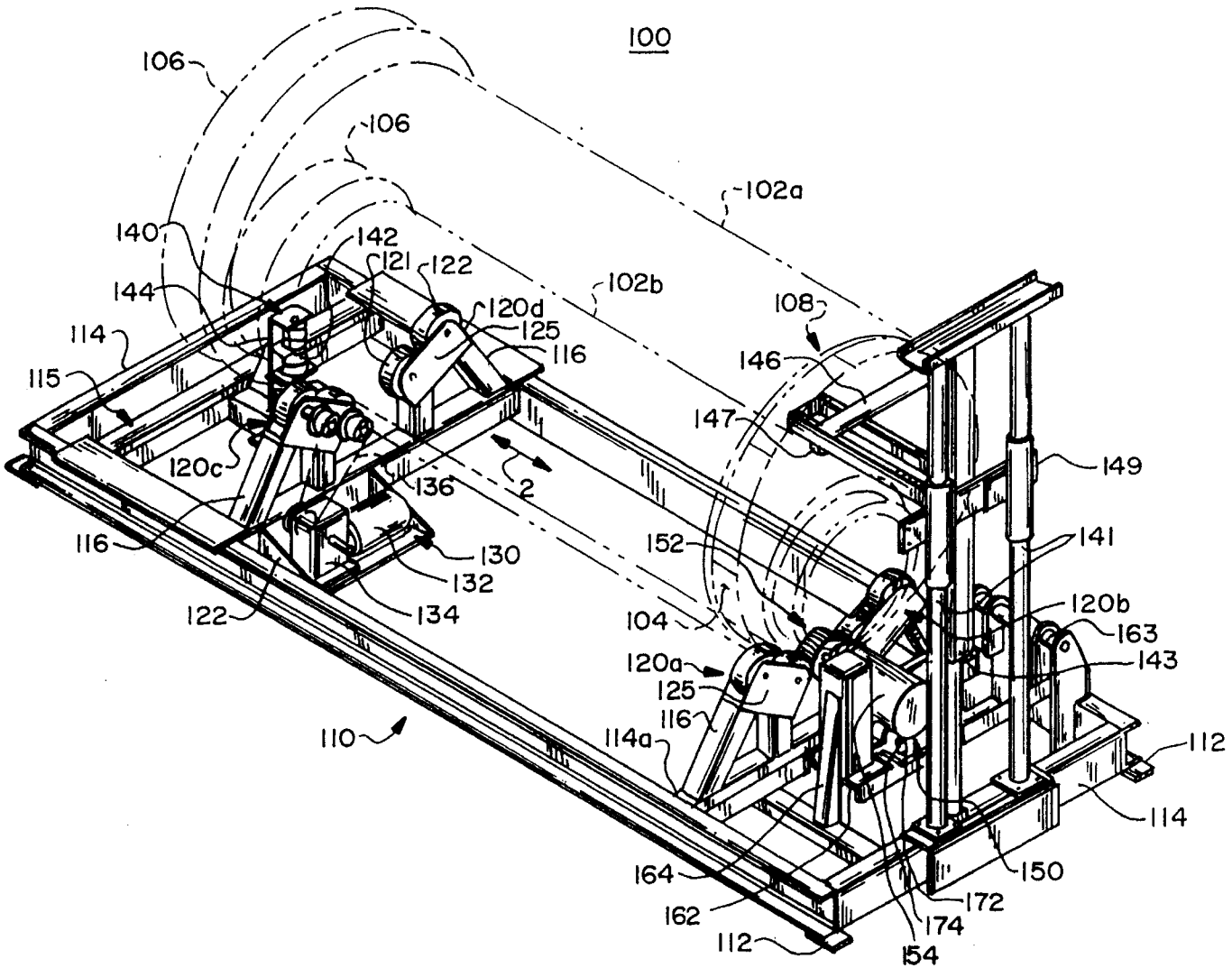
FIG. 1 is a perspective view of the present grinding apparatus with two various diameter workpieces shown in phantom.

The grinding apparatus 100, FIG. 1, according to the present invention is used to grind a surface 104 such as a spigot on a workpiece 102 such as a pipe according to the method of the present invention. The broad concept of the grinding method according to the present invention involves supporting the workpiece 102 directly on the surface being ground 104, while grinding the surface 104. This method and apparatus is particularly useful to grind a spigot on a pipe, such as a reinforced or non-reinforced concrete pipe used in underground drainage systems. Generally, the grinding apparatus includes a frame 110, one or more workpiece support roller members 120, a workpiece rotator mechanism 130, and a surface cutter or grinding mechanism 150.

The grinding apparatus frame 110 is positioned against a flat surface, such as the earth, and supports and stabilizes the grinding apparatus 100 during grinding. The frame 110 is constructed of structural members 112, 114 such as steel channel beams or "I" beams which are fixed together, for example, by welding. In a preferred embodiment, the frame 110 includes two elongated longitudinal structural members 112 on either side, two end connecting structural members 114, and a central structural member **114*a* which are generally perpendicular to the side structural members 112. One example of structural members 112, includes 8"×⅜" channel beams while connecting members 114** are fashioned from 8" square tubing with ½" diameter walls.

Workpiece roller members 120 rotatably support the workpiece 102 during grinding. The grinding apparatus includes at least first and second opposing workpiece roller members **120*a*–120*b* fixed to the connecting frame member 114 by support mounts 116, and adapted to contact and rotatably support the workpiece directly on the surface being ground 104 at a first end 108 of the workpiece 102. At least two additional (third and fourth) workpiece roller members 120*c*–120*d* are fixed to a moveable or adjustable support platform 115 resting on or coupled to frame 110, by support mounts 116 proximate an opposite end of the workpiece to generally support the workpiece 102 at a second end 106 opposite the first end 108**.

In the preferred embodiment, the workpiece roller members **120*a*–120*d* each include first and second rollers 121, 122. The rollers are mounted at an angle, each at a different vertical distance from the horizontal surface of cutter mechanism 150. Providing each workpiece roller member 120 with two rollers 121, 122 allows different size workpieces 102*a*, 102*b* to be supported on the present apparatus 100** without adjusting any workpiece roller members.

For example, the present invention contemplates that one roller, such as roller 121, from each roller support member **120*a*–120*d* can support a pipe with an outside diameter of approximately 15" to 33", while a second roller 122 from each workpiece roller member 120*a*–120*d* can support a pipe with an outside diameter of 30 to 60 inches, or larger. In the preferred embodiment, the individual rollers 121, 122 are mounted at an angle of approximately 32 degrees, from the horizontal plane. In addition, the lower rollers 121 are approximately 16" apart while the upper rollers 122 are approximately 31" apart. The workpiece support roller members 120*a*–120*d* are fixed to workpiece support mounts 116** although this is not a limitation of the present invention.

The second pair of workpiece roller support members **120*a*–120*d* mounted to adjustable platform 115 can then be adjusted along the frame 110 in the longitudinal direction indicated by arrow 2, to accommodate workpieces or pipes 102 of varying lengths. Typically, roller members 120*a*–120*b* stay generally fixed in place while roller members 120*c*–120*d* are adjusted based on the length of the workpiece 102**.

The preferred embodiment of each of the workpiece roller members **120*a*–120*d* further includes rollers 121, 122, rotatably supported between brackets 125 which are fixed to support mounts 116. The rollers 121–122 contact an outer surface of workpiece 102 and rotate with the rotating workpiece 102. One example of a workpiece support wheel 121** includes a steel polyurethane coated wheel having a diameter of approximately 8 inches, and a width of approximately 2½ inches.

The workpiece rotator mechanism 130 of the grinding apparatus 100 is preferably fixed to moveable platform 115, for driving or rotating the workpiece 102 while grinding. In the preferred embodiment, the workpiece rotator mechanism 130 includes a motor 132 which drives one or more of the rollers 121, 122 causing the workpiece 102 to rotate by frictional contact between the rollers 121, 122 and the outer surface of workpiece 102.

The workpiece rotator mechanism 130 is shown driving rollers 121, 122 or roller mechanism 120*c* at the second end 106 of workpiece 102, but could also be positioned at the first end 108 of workpiece 102 to drive roller mechanism 120*a* or 120*b* which is in contact with the surface being ground 104. Alternatively, a workpiece rotator mechanism 130 could be provided separate from the workpiece roller members 120*a*–120*d*. The present invention also contemplates other rotator mechanisms known to those skilled in the art for rotating workpieces and which can be utilized during grinding or cutting operations.

The preferred embodiment of the workpiece rotator mechanism 130 includes motor 132 which drives the rollers 121–122 by way of a gear box 134 and a chain 136. The driving motor 132 and gear box 134 are attached to and supported by mounting plate 122 attached to moveable platform 115. One type of drive motor 132 which can be used is a 2 hp. electric motor. The gear box 134 and chain 136 then reduce and transfer the output of the motor 132 to the rollers 121–122, as will be described in greater detail below. The preferred angular velocity or rotator speed of the rollers 121, 122 is approximately 30 RPM, while the workpiece 102 rotates in the range of 4–20 RPM based on pipe diameter.

The preferred embodiment of the grinding apparatus 100 further includes an end workpiece support 140, fixed to the adjustable platform 115 at an end opposite the cutter mechanism 150, for preventing movement of the workpiece in the longitudinal direction indicated by arrow 2 away from cutter mechanism 150. The end workpiece support 140 includes at least one wheel 142 rotatably supported vertically by end wheel bracket 144.

The cutter or surface grinding mechanism 150 of the grinding apparatus 100 is mounted to the frame 110, for cutting, grinding or otherwise milling the surface 104 at the first end 108 of the workpiece. Preferably, the surface grinding mechanism 150 is adjustable in a vertical direction and in an angular direction, as will be discussed in greater detail below. The cutter mechanism 150 includes a rotating cutter 152, such as a diamond grinding wheel, and a drive motor 154, for driving or rotating the rotating cutter 152. One type of cutter 152 which may be used is a diamond grinding wheel, but the present invention also contemplates other types of cutters used in grinding, milling or turning. One type of driving motor which may be used is a 15 hp. electric motor capable of rotating the cutter 152 at 3450 RPM. The cutter mechanism 150 further includes a spindle assembly for mounting the cutter 152 or grinding wheel, as will be explained in greater detail below.

One type of vertical adjustment mechanism includes a drive motor support plate 162 pivotably supported to a structural member 112 of the frame 110 with pivotable supports 163. A feed screw 164 is threadably engaged with a threaded portion of the support plate 162. The feed screw, or hydraulic or pneumatic cylinder 164 or other similar mechanism can then be utilized to raise or lower the support plate 162 and thereby raise or lower the cutter 152. The present invention contemplates other types of adjustment mechanisms known to those skilled in the art, for vertically adjusting the cutter mechanism 150. Preferably, an electromechanical or electrohydraulic control mechanism can be used to monitor and control the vertical adjustment, as discussed in greater detail below.

One type of cutter or grinder head 152 angular adjustment mechanism which can be used with the present invention operates in a similar manner and includes a second support plate 172 pivotably supported to the drive motor support plate 162. One or more adjustment means such as screws 174 are threadably engaged with a threaded portion of the support plate 172, for adjusting the angle of the cutter 152 with respect to a longitudinal axis 2 of the workpiece 102.

The present invention also contemplates other adjustment mechanisms known to those skilled in the art, for adjusting the cutting angle of the cutter 152. An electro-mechanical or electrohydraulic angular and/or positional adjustment control system can also be provided to monitor and control the angular adjustment of the surface grinding mechanism 150, as discussed in greater detail below.

The preferred embodiment of the grinder 100 of the present invention also includes a top workpiece support 146 with one or more support wheels 147 which rests on the top of workpiece 102. Top workpiece support 146 is coupled to a frame 149, such as a tubular frame, which is slidably engaged with one or more round support columns 141. The round columns 141 are coupled to frame member 114 of frame 110. The top workpiece support 146 can be raised and lowered utilizing mechanical, electromechanical, or an electrohydraulic mechanism 143 which will be explained in greater detail below.

After adjusting workpiece roller members 120*c*–120*d* to the desired position according to the length of the workpiece or pipe 102, the workpiece 102 is placed lengthwise on the workpiece roller members 120*a*–120*d* which support the weight of the pipe. One wheel 121, 122 of each roller member 120*a*–120*d* will contact the workpiece. The workpiece is positioned so that the rollers 121 or 122 will contact only the surface 104 being ground, e.g. a spigot or "tongue" on a pipe, during the grinding of the workpiece 102. If the grinding apparatus 100 includes an end support 140, the end support is adjusted to be positioned against an end face of the workpiece 102 at the second end 106 proximate the "bell" or "socket".

Figure 2:
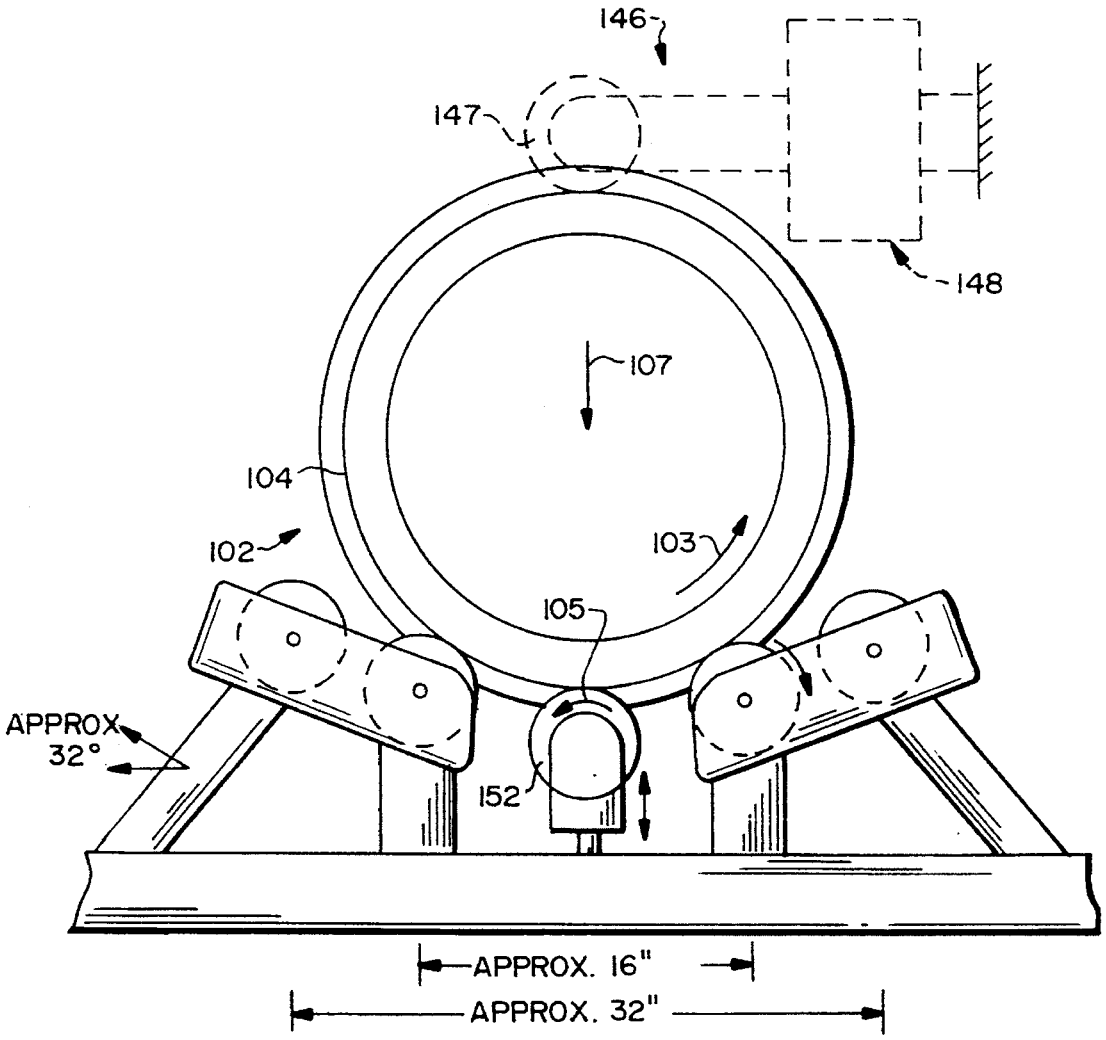
FIG. 2 is a schematic view illustrating the workpiece support roller members of the grinding apparatus supporting the workpiece on the surface being ground during grinding.

Next, workpiece 102 is preferably rotated in a first direction such as a direction indicated generally by arrow 103, FIG. 2, with rotator mechanism 130. The cutter 152 is then rotated in a second direction opposite the first direction of rotation of the workpiece 102 as shown by arrow 105. The cutter 152 is then moved upward into contact with the surface 104 to begin grinding. As the surface 104 of the workpiece 102 is ground, the surface 104 is maintained in contact with rollers 121 or 122 preferably, by the weight of the workpiece. Thus, as the surface 104 is ground, the workpiece 102 moves downward toward the cutter 152 in the direction of arrow 107 so that the workpiece self-feeds and maintains contact with the cutter 152. The direction of turn of the workpiece and cutter is not a limitation of the present invention and several combinations are possible and considered to be within the scope of the present invention.

The grinding continues until a predetermined depth (or spigot diameter) is reached. For example, mechanical or automated measuring devices known to those skilled in the art can be used to measure the predetermined depth. Because the surface of the workpiece being ground 104 rests directly on the two rollers, with the grinder 152 placed between yet below the upper surface of the rollers, the resulting ground surface 104 develops, after several rotations, the necessary roundness at close tolerances (within 0.010") despite any irregularity in the shape, diameter or surface of the pipe 102.

An alternative embodiment of the grinding apparatus 100 includes a top workpiece support 146 with one or more support wheels 147, for providing additional support and preventing movement of the workpiece 102 in the vertical direction during grinding. The top support is adapted to be positioned against the top surface of the workpiece 102 and preferably, will contact the grinding surface 104. In this way, the top support 146 can also be used to measure the depth of the surface 104 being ground, e.g. a spigot diameter, with a measuring device or electronics 148 to determine when grinding is finished.

In one example, the top workpiece support 146 includes an air or hydraulic operated mechanism, for moving the support 146 into position against the top region of the workpiece 102. During grinding, if the weight of the workpiece 102 is not sufficient to maintain contact of surface 104 with rollers 121, 122 the top workpiece support 146 will help maintain contact of the surface being ground 104 with the grinder 152 and facilitate grinding.

Figure 3:
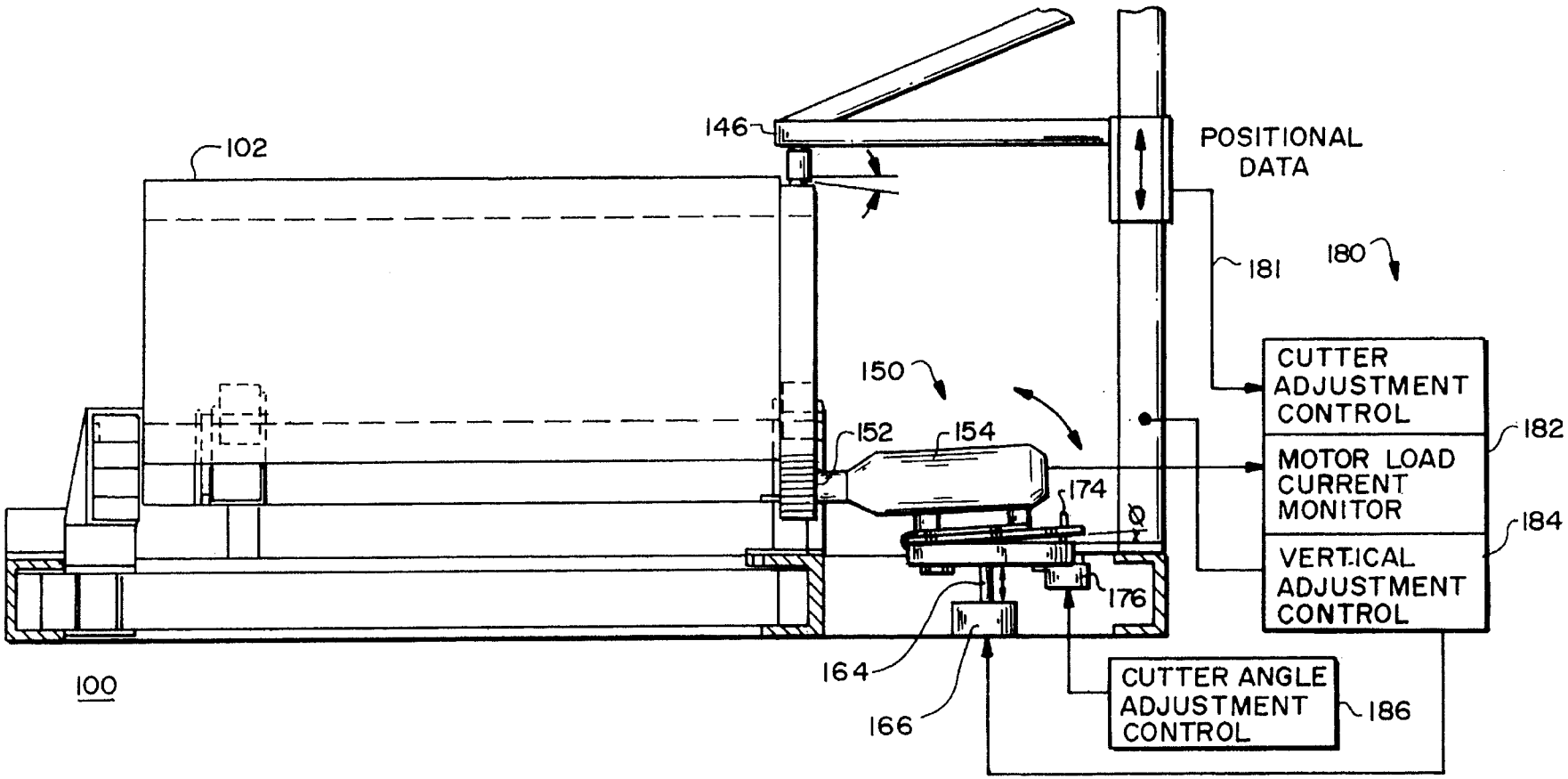
FIG. 3 is a partial cutaway view of the grinding apparatus grinding a workpiece and a schematic illustration of a grinder adjustment and top hold down control system.

Turning to FIG. 3, the adjustment mechanism and adjustment control system will be discussed in greater detail. As mentioned above, one way of adjusting the surface grinding mechanism 150 is with manual feed screws 164, 174. In one embodiment, the grinding apparatus 100 includes an automated hydraulic/pneumatic vertical adjustment system 166, which automatically drives hydraulic cylinders for automatically raising or lowering the cutter 152.

The grinding apparatus 100 having an automatic adjustment mechanism 166 can further include a grinder adjustment control system 180, for monitoring the surface grinding mechanism 150 and controlling the adjustment of the surface grinding mechanism 150.

In a preferred embodiment, the grinder adjustment control system 180 includes a motor load current monitor 182, electrically coupled to the grinder drive motor 154, for monitoring the current in or being drawn by the motor 154. Accordingly, the motor load current monitor 182 monitors the load on the motor 154 caused by resistance of the rotating grinder 152, as a grinding wheel grinds the workpiece 102 and can determine whether the cutter 152 is in contact with the workpiece 102 and estimate the feed rate of cutter 152.

The cutter adjustment control system 180 may further include a grinder vertical adjustment controller 184 coupled to the motor load current monitor 182, and responsive to vertical positional data 181 relative to top workpiece support 146 and electrically coupled to the automatic adjustment mechanism 166. The grinder vertical adjustment controller 184 receives signals from the motor load current monitor 182 and preferably from top workpiece support 146 and in response to those signals, activates the automatic adjustment mechanism 166, such as an electrohydraulic cylinder to a servomotor, to adjust the grinder mechanism 150 accordingly.

For example, if the motor load current monitor 182 monitors the load current and detects a minimal load on the motor 154 (i.e. the grinder 152 is not in contact with the workpiece 102), the grinder vertical adjustment control 184 will activate the automatic adjustment mechanism 166 to raise the grinder 152 until a predetermined load current is detected by the motor load current monitor 182 (i.e. the grinder 152 is in contact with and grinding the workpiece 102). Feeding or raising the grinder 152 continues at a nominal rate provided the load current detected by the motor load current monitor 182 is not excessive or providing positional data 181 provided by top workpiece support 146 does not indicate that the workpiece has been ground to the desired depth and grinding should be stopped.

As described above, the cutting angle can be adjusted, such as by adjusting one or more adjustment screws 174 or using a hydraulic or pneumatic cylinder, and pivoting the surface grinding mechanism 150. One application of adjusting the cutting angle is to grind an angled spigot at an angle of between 0 and 5 degrees. An automatic cutter angle adjustment mechanism 176 can be provided, such as a hydraulic piston 174. Further, a grinder angle adjustment control 186 can automatically control the grinder angle adjustment mechanism 176.

Figure 4:
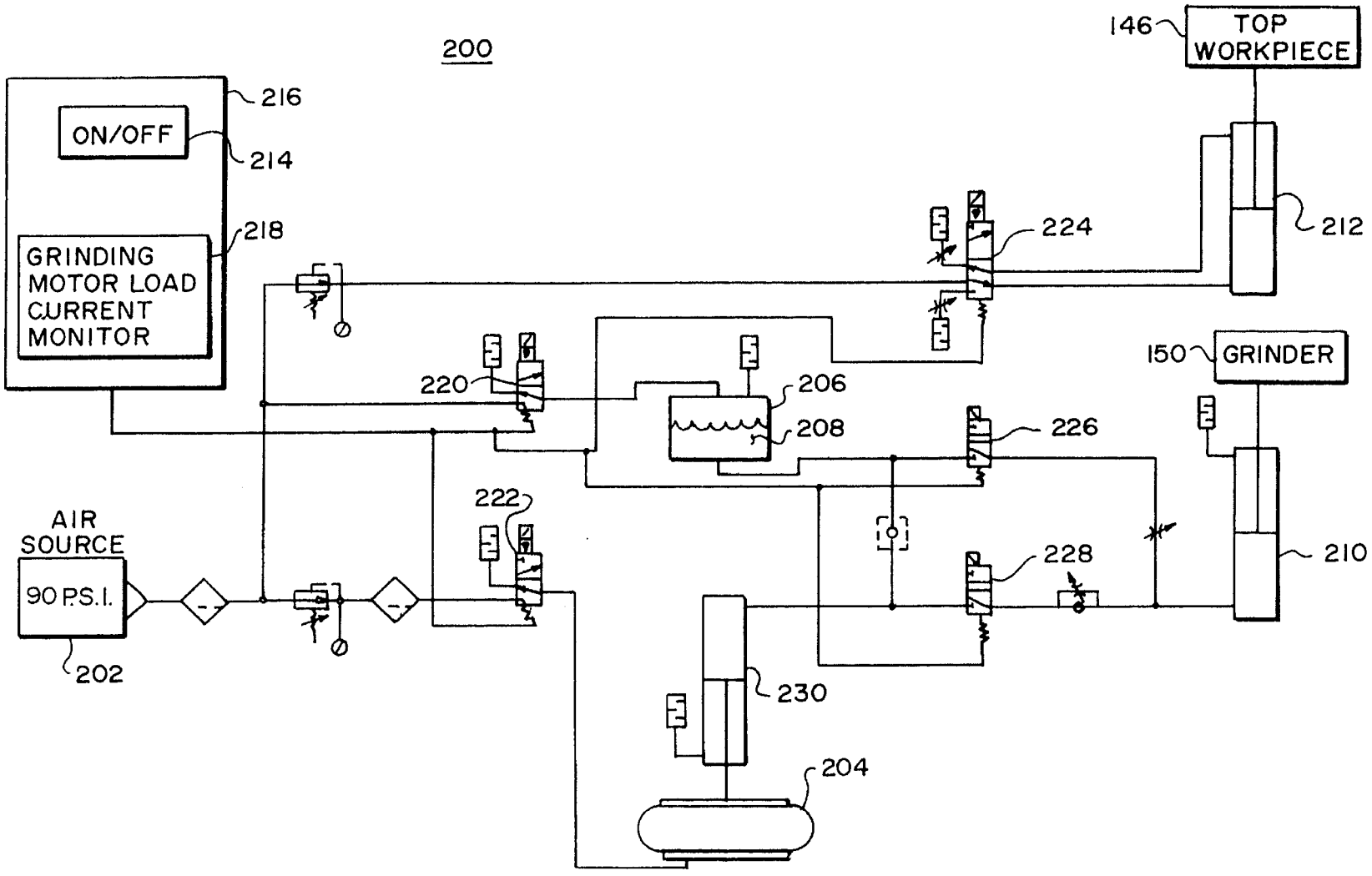
FIG. 4 is a schematic diagram of one implementation of a grinder adjustment and top hold down control system according to one aspect of the present invention.

An exemplary pneumatic/hydraulic system for controlling the position of the grinding assembly and the position of the top workpiece is shown in greater detail generally at 200, FIG. 4. The system includes a source of compressed air 202 typically an air compressor, providing air at approximately 90 pounds per square inch. An air bladder such as a rubber or similar expandable and compressible air storage container 204 is provided, coupled to resource of compressed air 202. The system also includes a source or reservoir of hydraulic fluid 206 which serves to store a supply of hydraulic liquid 208.

A first hydraulic piston 210 is coupled to grinder 150, and serves to raise and lower the grinding assembly 150 vertically, into and out of contact with the workpiece to be ground. A second hydraulic cylinder 212 is coupled to the top workpiece support 146, and serves to raise and lower the top workpiece support 146 into and out of contact with the workpiece.

The system also includes an electrical on and off switch 214 which forms part of the electronics circuitry 216, for energizing the workpiece grinding system of the present invention. The electronic system 216 also includes a grinding motor load current monitor 218 which, utilizing an inductive or other similar type monitor, monitors the current in the grinding mechanism 150. The electronics system 216 is coupled to first, second and third pneumatic valves 220–224, as well as first and second hydraulic valves 226 and 228.

When the system is in use, once the main electronics switch 214 has been energized, the grinding mechanism 150 has been energized, and the workpiece rotator mechanism rotation has been started, this signifies the "start" of the pipe grinding cycle. Pneumatic valves 222 and 224 will be energized which will fill air bladder 204 and energy air cylinder 212 to move top workpiece 146 into contact with the top region of the workpiece being ground.

In the initial mode, bladder 204 compresses hydraulic cylinder 230 which pressurizes the hydraulic reservoir 206. Hydraulic valves 226 and 228, controlled by electronics 216, cause the grinding mechanism hydraulic cylinder or piston 210 to advance or raise grinder mechanism 150 until the grinding motor load current monitor 218 detects that the grinding mechanism 150 has made contact with the pipe.

Once the system 200 receives an indication that the proper diameter of the pipe has been reached, electronics 216 energizes hydraulic valve 226 and deenergizes hydraulic valve 228 as well as deenergizing pneumatic valves 220, 222 and 224. This allows any hydraulic fluid in piston or cylinder 210 to flow back into hydraulic fluid reservoir 206 and decompresses the piston 230 associated with he air bladder 204.

When the electronics 216 detect that the grinding mechanism 150 has settled to a bottom most position, such as by sensing a limit switch, hydraulic valves 226 and 228 are deenergized and the system awaits the start of another cycle. Although one implementation of a grinding mechanism control apparatus has been explained in conjunction with electromechanical and electrohydraulic/pneumatic components, this is not a limitation of the present invention as any comparable mechanism, well known to those skilled in the art, may be utilized.

Figure 5:
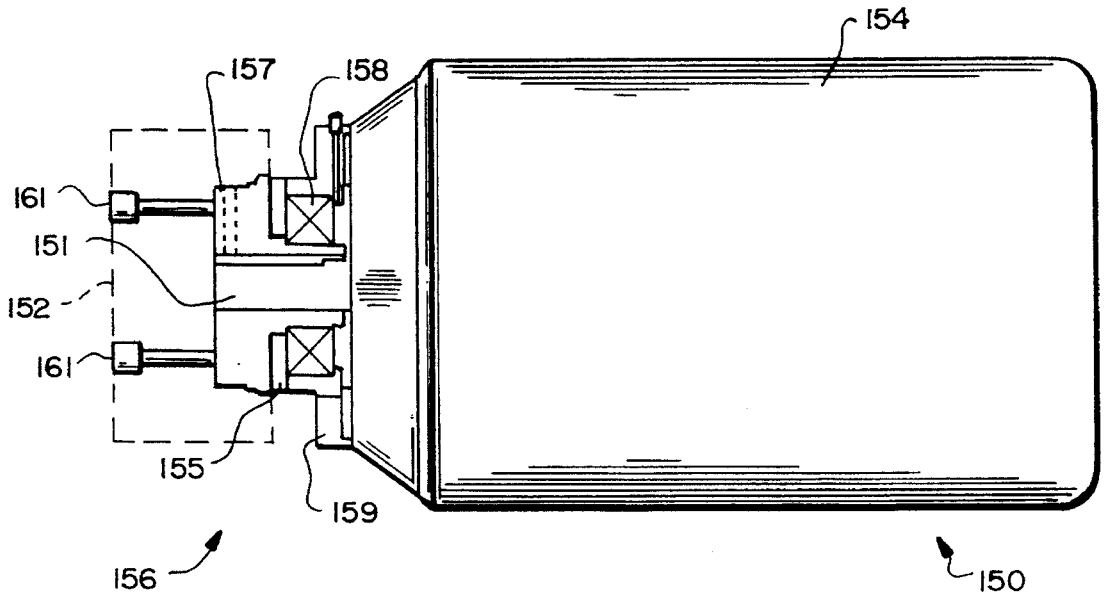
FIG. 5 is a partial cutaway view of a spindle assembly for mounting a grinding wheel.

Turning to FIG. 5, the spindle assembly 156 which mounts the grinder 152 to motor 154 will be described in greater detail. The spindle assembly 156 includes a hub 157 which supports the grinder 152, e.g. a grinding wheel. The hub 157 is mounted to spindle 151 of the motor 150 using two or more bolts 161 and rotatably supported and coupled to the spindle assembly 156 by bearings 158. The bearings 158 and hub 157 are further supported by a "C" face motor adapter 159 and cap 155 which couples to a standard "C" face of a motor 154. The present invention also contemplates other types of spindle assemblies known to those skilled in the art, for mounting cutters such as grinding wheels or milling cutters. An example of an exemplary spindle includes a grinding wheel spindle available from NPC Corporation, Milford, N.H.

Figure 6:
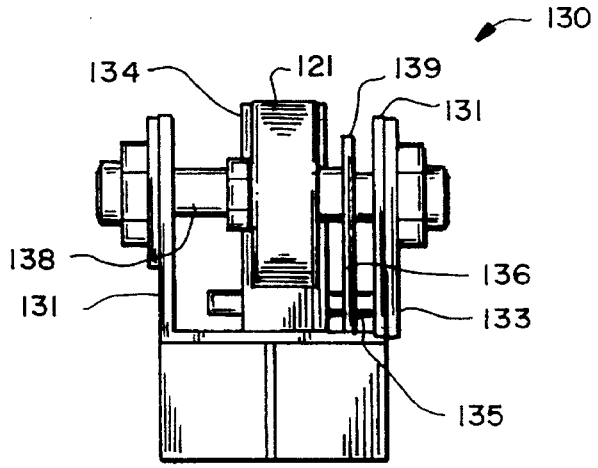
FIG. 6 is an enlarged side view of a workpiece rotator mechanism.

Turning to FIG. 6, the preferred embodiment of workpiece rotator mechanism 130 will be described in greater detail. As described above, a drive motor 132 rotates one or more rollers 121–122 by way of a gear box 134 and chain 136. The workpiece rotator mechanism 130 may further include one or more drive shafts 138 rotatably supported by brackets 131 and supporting rollers 121–122. A sprocket 139 is mounted to the shaft 138. The chain 136 engages the teeth of the sprocket 139 to rotate the shaft 138 and the roller 121–122. In one example, the shaft 138 has a diameter of approximately 1 15/16 inches and a length of approximately 16 inches; the sprocket 139 has 20 teeth, a diameter of 5" and the chain 136 is 4 ft. in length.

The workpiece driver mechanism 130 can further include a chain guard 133 which covers and protects the chain 136 as the chain drives the roller(s) 121–122. The chain 136 engages and is driven by a sprocket coupled to an output shaft 135 of the gear box 134 and transfers rotation to the sprocket 139, shaft 138, and roller 121–122. The present invention contemplates other workpiece driver mechanisms as are well known to those skilled in the art.

Accordingly, the present invention provides a relatively simple grinding apparatus which can grind a spigot on even an out-of-round pipe to a desired diameter within very close tolerances. Supporting the pipe on the surface which is being ground during grinding results in the simple and precise grinding of the spigot at the end of the pipe and in eliminating any out-of-roundness in the pipe. Furthermore, the grinding apparatus and method of grinding by supporting the pipe on the surface being ground allows the workpiece or pipe to self-feed towards the cutter mechanism, and allows the grinder mechanism located between and below the two support rollers to correct any out of roundness of the workpiece. An automatic adjustment cutter mechanism and a top support having a measuring device further allows the grinding apparatus to be easily automatically operated to grind an accurately measured spigot on a pipe.

Modifications and substitutions by one of ordinary skill in the art are considered to be within the scope of the present invention which is not to be limited except by the claims which follow.

What is claimed is:

1. A method of grinding a surface on a workpiece, using a grinding apparatus having a workpiece support mechanism, a surface grinding mechanism, and a workpiece rotator mechanism, said method comprising the steps of:

rotatably supporting said workpiece on said workpiece support mechanism, including resting said workpiece on said workpiece support mechanism and supporting said workpiece on said surface being ground with at least two opposing workpiece support mechanism roller members positioned generally beneath said workpiece at a first end of said workpiece and in contact with said surface being ground rotating said workpiece with said workpiece rotator mechanism;

grinding said surface of said workpiece with said surface grinding mechanism, to a predetermined depth wherein said surface grinding mechanism rotates about an axis parallel to a longitudinal axis of rotation of said workpiece; and maintaining contact of said surface being ground with said workpiece support mechanism while grinding said surface.

2. The method of claim 1, wherein said step of rotatably supporting said workpiece on said workpiece support mechanism includes rotatably supporting said workpiece on at least four workpiece support mechanism roller members, whereby first and second workpiece support mechanism roller members support said workpiece at a first end by contacting said surface being ground, and whereby third and fourth workpiece support mechanism roller members support said workpiece proximate a second end of said workpiece.

3. The method of claim 2, wherein said workpiece is supported entirely by said at least four workpiece support mechanism roller members positioned generally beneath said workpiece.

4. The method of claim 1, further including the step of providing an end workpiece support member, for preventing horizontal movement of said workpiece.

5. The method of claim 1, further including the step of providing a top workpiece support member generally at a top region of said workpiece, for preventing vertical movement of said workpiece and maintaining contact of said surface with said workpiece support mechanism and said surface grinding mechanism while grinding said surface.

6. The method of claim 2, wherein said step of rotating said workpiece with said workpiece rotator mechanism includes rotating at least one of said at least four workpiece support mechanism roller members with said workpiece rotator mechanism which includes a driving motor, whereby said at least one of said at least four workpiece support mechanism roller members frictionally contacts and rotates said workpiece.

7. The method of claim 6, wherein said step of rotating one of said at least four workpiece support mechanism roller members includes rotating a workpiece support mechanism roller member which supports said workpiece at said second end of said workpiece.

8. The method of claim 1, wherein said step of grinding said surface with said surface grinding mechanism includes rotating a grinding element of said surface grinding mechanism in a direction opposite a rotational direction of said workpiece which is being rotated.

9. The method of claim 1, further including self-feeding said workpiece toward said surface grinding mechanism, whereby said workpiece moves toward said surface grinding mechanism as said surface is ground and maintains contact with said workpiece support mechanism by a weight of said workpiece.

10. The method of claim 1, further including the step of adjusting said surface grinding mechanism in a vertical direction.

11. The method of claim 1, further including adjusting an angle of said cutter mechanism with respect to a longitudinal axis of said workpiece, for grinding an angled surface in said workpiece.

12. The method of claim 10, further including monitoring a load current in a driving motor rotating said surface grinder mechanism, and automatically adjusting said surface grinding mechanism according to said load current.

13. The method of claim 1, wherein said step of grinding said surface includes grinding a spigot in a pipe.

14. The method of claim 13, wherein said pipe is a concrete pipe.

15. The method of claim 1, wherein said workpiece support mechanism includes a plurality of roller members, each roller member including two rollers disposed at a different height with respect to one another.

16. A grinding apparatus, for grinding a surface in a workpiece, said grinding apparatus comprising:

a frame, for stabilizing said grinding apparatus on a generally flat surface;

a workpiece support, mechanism coupled to said frame, for rotatably supporting said workpiece, said workpiece support mechanism including at least a first workpiece support member fixed opposite at least a second workpiece support mechanism roller member, and wherein said at least a first workpiece support mechanism roller member and said at least a second workpiece support mechanism roller member are adapted to rotatably support said workpiece on said workpiece surface to be ground;

a workpiece rotator mechanism, for rotating said workpiece in at least a first direction; and a surface grinding mechanism, coupled between said at least a first workpiece support mechanism roller member and said at least a second workpiece support mechanism roller member, and adapted to be positioned adjacent said workpiece surface to be ground, for grinding said surface as said workpiece is supported on said surface by said at least a first workpiece support member and said at least a second workpiece support member.

17. The grinding apparatus of claim 16, wherein said at least first and second workpiece support mechanism roller members each include first and second rollers.

18. The grinding apparatus of claim 17, wherein said workpiece support mechanism further includes at least third and a fourth workpiece support mechanism roller members coupled to said frame at an end opposite said surface grinding mechanism and adapted to be positioned beneath said workpiece.

19. The grinding apparatus of claim 18, wherein said workpiece rotator mechanism includes a motor which drives at least one of said workpiece support mechanism roller member rollers, wherein said at least one of said workpiece support mechanism roller member rollers is adapted to frictionally contact and rotate the workpiece.

20. The grinding apparatus of claim 18, wherein said surface grinding mechanism includes a rotating grinder and a motor for driving said rotating grinder.

21. The grinding apparatus of claim 18, further including an end workpiece support member, coupled to said frame at an end opposite said surface grinding mechanism, for preventing horizontal movement of said workpiece during grinding.

22. The grinding apparatus of claim 17, further including a grinding adjustment mechanism, coupled to said surface grinding mechanism, for adjusting said surface grinding mechanism.

23. The grinding apparatus of claim 22, wherein said grinding adjustment mechanism includes a vertical adjustment mechanism.

24. The grinding apparatus of claim 22, wherein said grinding adjustment mechanism includes a grinding angle adjustment mechanism.

25. The grinding apparatus of claim 22, further including a grinding adjustment control mechanism, for controlling and monitoring adjustment of said surface grinding mechanism.

26. The grinding apparatus of claim 16, further including a top workpiece support member, coupled to said frame, and adapted to be positioned against a top region of said workpiece, for maintaining said surface in contact with said at least a first workpiece support mechanism roller member and said at least a second workpiece support mechanism roller member.

27. The grinding apparatus of claim 18, further including a measuring device, for measuring said surface being ground.

28. The grinding apparatus of claim 17, wherein said first and second rollers of said workpiece support mechanism roller members are disposed at different heights.

29. The grinding apparatus of claim 28, wherein said surface grinding mechanism includes a rotating grinder having a top region which is lower than a top region of said first and second rollers.

30. A method of grinding a surface on a workpiece, using a grinding apparatus having a workpiece support mechanism, a surface grinding mechanism, and a workpiece rotator mechanism, said method comprising the steps of:

rotatably supporting said workpiece on said workpiece support mechanism, whereby said workpiece support mechanism rotatably supports said workpiece on a surface which is being ground;

rotating said workpiece with said workpiece rotator mechanism;

grinding said surface of said workpiece with said surface grinding mechanism, to a predetermined depth;

maintaining contact of said surface being ground with said workpiece support mechanism while grinding said surface; and self-feeding said workpiece toward said surface grinding mechanism, whereby said workpiece moves toward said surface grinding mechanism as said surface is ground and maintains contact with said workpiece support mechanism by a weight of said workpiece.

31. A method of grinding a surface on a workpiece, using a grinding apparatus having a workpiece support mechanism, a surface grinding mechanism, and a workpiece rotator mechanism, said method comprising the steps of:

rotatably supporting said workpiece on said workpiece support mechanism, whereby said workpiece support mechanism rotatably supports said workpiece on a surface which is being ground;

rotating said workpiece about a longitudinal axis of rotation with said workpiece rotator mechanism;

grinding said surface of said workpiece with said surface grinding mechanism, to a predetermined depth, wherein said surface grinding mechanism rotates about an axis parallel to said longitudinal axis of rotation of said workpiece; and maintaining contact of said surface being ground with said workpiece support mechanism while grinding said surface.

* * * * *